United States Patent [19]

Charlton

[11] 4,092,933

[45] June 6, 1978

[54] BRACING DEVICE

[76] Inventor: Thomas Charlton, 13931 S. Stoneshire, Houston, Tex. 77037

[21] Appl. No.: 622,125

[22] Filed: Oct. 14, 1975

Related U.S. Application Data

[63] Continuation-in-part of Ser. No. 585,083, Jun. 9, 1975, abandoned.

[51] Int. Cl.[2] ..... B65J 1/22

[52] U.S. Cl. ..... 105/366 R; 105/368 B; 105/486; 280/179 R; 292/194

[58] Field of Search ..... 105/366 R, 366 A, 366 B, 105/366 C, 366 D, 366 E, 368 R, 368 B, 463, 464, 465, 381, 382, 387, 486, 487; 280/179 R; 248/119 R, 119 S; 292/1, 194, 300, 338, 339, DIG. 15; 220/1.5; 104/254; 267/136, 138, 139; 49/35, 49, 131, 386; 256/13.1

[56] References Cited

U.S. PATENT DOCUMENTS

| | | | |
|---|---|---|---|
| 846,260 | 3/1907 | Symons | 104/254 |
| 1,675,701 | 7/1928 | Fitch | 105/366 D X |
| 1,887,707 | 11/1932 | Bates et al. | 220/1.5 |
| 2,972,490 | 2/1961 | Styx | 280/179 R |
| 3,193,122 | 7/1965 | Sauthoff | 105/366 R X |
| 3,854,423 | 12/1974 | Bridge | 105/366 D X |
| 3,916,799 | 11/1975 | Smith | 105/368 B |

*Primary Examiner*—Randolph A. Reese

[57] ABSTRACT

A restraining apparatus particularly intended to function as a brace for securing the doors of containerized cargo. The containers carried by a transporting vehicle such as a railway flatcar are characterized by end doors that are commonly subjected to forcible opening by trespassers intent upon pilferage. The apparatus, in its preferred embodiment, is positioned hingedly to the freight car floor and may readily be folded downwardly to a stowed position. The apparatus comprises a base member and an upstanding member integrally attached thereto. A forward biasing component extends between the base member and the supporting floor for forcibly directing the upstanding member against the containerized doors.

20 Claims, 4 Drawing Figures fig.1
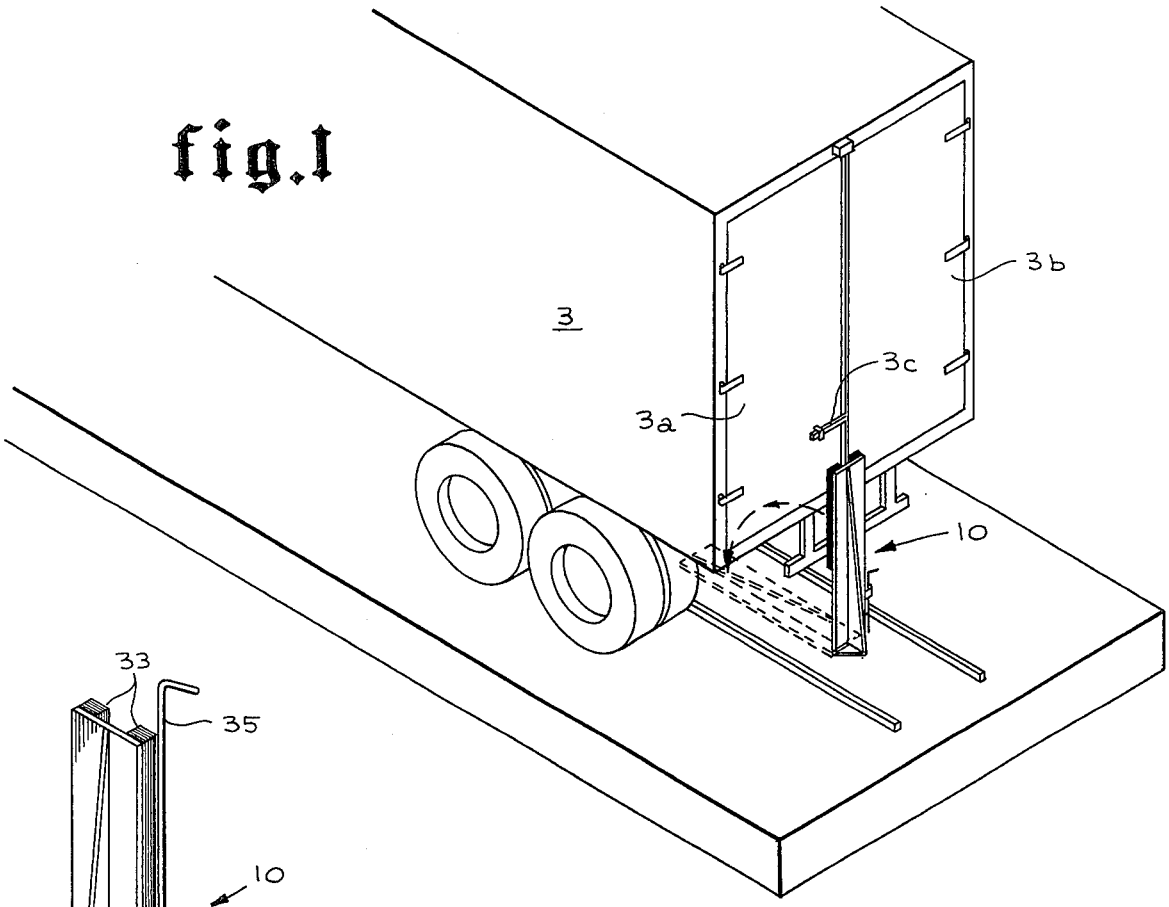
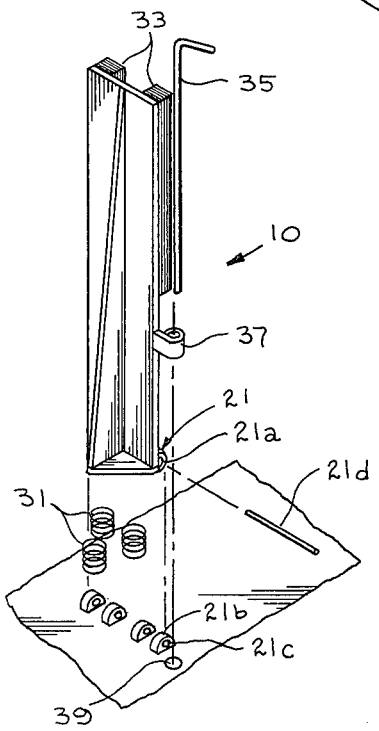
fig.2
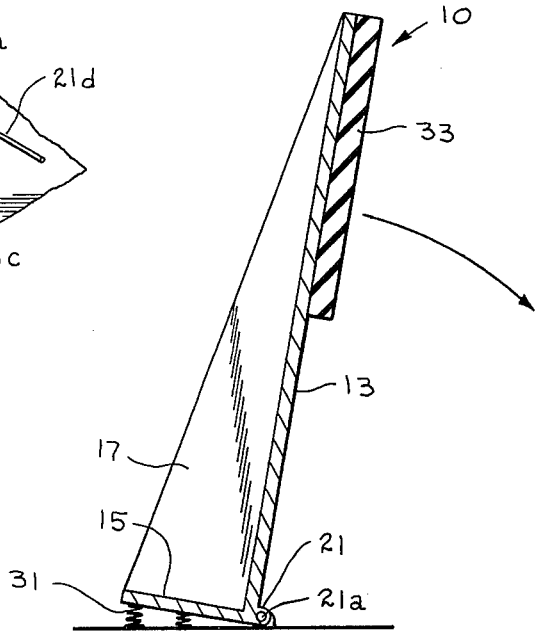
fig.3
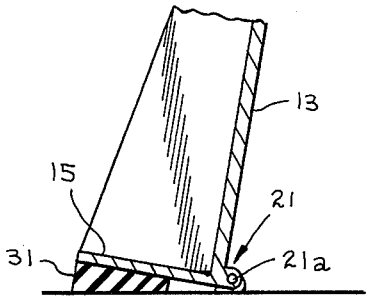
fig.4

BRACING DEVICE

This application is a continuation in-part of my earlier application entitled, "Improvement in a Bracing Device," filed in the Patent Office on June 9, 1975 and bearing the Ser. No. 585,083, now abandoned.

BACKGROUND OF THE INVENTION

The present invention relates to a structural apparatus used principally for security purposes. More particularly, the invention relates to braces which are adapted to be hingedly attached to cargo carrying vehicles such as railway flatcars, or the like, for the purpose of securing the doors of containerized cargo. Generally, this improved brace will insure against pilferage which is accomplished by trespassers who forcibly open the doors and, it will insure against loss due to damaged cargo which not infrequently shifts its position within the container and bursts through the doors when the transporting vehicle starts or stops suddenly.

In functional operation, the present invention is intended to accomplish many of the same objectives as expressed in my earlier aforementioned application entitled, "Improvement in a Bracing Device". A full appreciation of the differences between the two, however, requires an understanding of the background problem to which these apparati are directed. Briefly, the problem reveals itself most explicitly in the railway cargo industry where flatcars, those used extensively for many years, have relatively recently found an additional use in transporting that which is commonly known as "containerized cargo". The use of containers on railway flatcars has increased significantly in recent years. The relative ease of loading and unloading containers from one shipment vehicle, such as a truck, to another, such as a flatcar, by means of a crane or a specially manufactured container lift, makes such increase easily understandable. The containers themselves commonly take the form of a rectangular box having a reinforced structure, generally 8 feet wide and either 20 feet or 40 feet long. These rectangular boxes of "containers" commonly have end doors which are hinged at their vertical side so as to be adapted to be swung outwardly from the center where they are locked together.

Although there has been increased use of the "containerized" concepts of transporting cargo, there has developed concomitantly a problem in protecting the cargo contained therein from pilferage and other damage during shipment. The industry has devised numerous locking devices to secure the container doors but it appears that there yet exists to be found on the market any kind or type of locking mechanism that is not vulnerable to a heavy duty pair of metal snips or a crowbar or a similar apparatus, all of which, of course, can be purchased at any hardware store. Thus, by forcibly removing a padlock, chain lock or the like, the doors to the container may be opened from the center and the entire cargo exposed to pilferage and loss. The fact that containerized cargo frequently stands overnight on a flatcar in a railway yard only enhances the potential for loss and the fact that the railway cars themselves are subjected to sudden starts and stops when moving further enhances the probability that the cargo may shift against the container doors, thus snapping the locking device and allowing the freight to fall free from the container onto the surrounding terrain.

My prior application endeavored to obviate the aforementioned problems by disclosing the manner in which the tremendous weight of the container and its contents could be used advantageously as a part of the locking method and apparatus of the invention. Such disclosure noted that containers generally weigh 40,000 or more pounds and can be loaded or unloaded only with a crane or container-lift. In operation, my earlier described brace, is first properly positioned and engaged to the floor of the flatcar in the same way as described herein. The container is then lowered onto the flatcar, the brace abutting against the center of the container doors. Because the brace is locked to the floor of the flatcar, the container doors cannot be opened because to do so one must either move the container or the brace. The container cannot be moved because of its immense weight. The brace cannot be moved because removal from the flatcar floor requires that the container be unloaded from the flatcar and this requires, of course, the crane or special container-lift. The doors of the container are therefore secured. From the viewpoint of the potential intruder, the security brace disclosed is vulnerable only to a welder's cutting torch, this being, of course, readily detectable in most circumstances. The losses relating to shifting-cargo would be reduced substantially also since the brace itself is fixed, in static position, to the floor of the flatcar and cannot be removed therefrom without first removing the container.

My earlier application further disclosed a brace characterized by a pair of legs disposed in substantially perpendicular relation to one another to form an L-shaped apparatus. A diagonal strut reinforced the relative position of the legs with respect to one another. One of the legs is adapted to reside and rest horizontally on the floor of the flatcar and is to be engaged thereto by a plurality of engaging lugs which extended downwardly from the horizontal leg and into engaging relationship with slots in the floor of the railroad car in such a manner and position as to securely and fixedly connect the brace to the floor. The other leg of the brace is thus positioned against the end doors of the cargo container. When the brace was not in use it could be easily stored in a slot in the floor of the railway car by simply sliding the brace therethrough into a compartment beneath the floor. In such a manner, the brace provided an improved prefabricated apparatus that unquestionably precluded horizontal movement of cargo through the doors of containers carried by railroad cars or other transporting vehicles. There was further provided an improved bracing means for use on cargo vehicles and which precluded pilferage by the opening of doors on the containers. There was further provided a unique apparatus of the simplest design which is both inexpensive to manufacture and simple to use. Moreover, the apparatus contains no moving parts such as characterizes a lock and is so durable in construction and design as to make it virtually indestructible except by loss.

The present invention not only accomplishes all of the objectives and advantages of my earlier invention but is, in addition, advantageous thereover in certain respects.

First, the present invention is hingedly affixed to the floor of the transporting vehicle and thus precludes the necessity to lift it and insert it in the slots of the vehicle floor in order to achieve its operative position.

Similarly, the apparatus hereof need not be removed from its operative position and physically carried to its stowed position when not in functional operation.

The present apparatus may be moved from its operative to its stowed position simply by tipping it over and laying it on the floor of the transporting vehicle. The apparatus cannot be damaged or adversely affected in any way.

Also, the apparatus herein can be disposed in its operative position on a flatcar, for example, and a truck bearing a container thereon, or simply having container-type doors, can be backed onto the flatcar and up to the bracing means hereof without substantial assistance or direction from another person.

These and numerous other features and advantages of the invention will become more readily apparent upon a reading of the following detailed description, claims and drawings, wherein like numerals denote like parts in these several views and wherein:

DESCRIPTION OF THE DRAWINGS

FIG. 1 is a perspective view of an exemplary cargo brace in accordance with the principles hereof, disposed in operative position against a pair of end doors.

FIG. 2 is a perspective view of the cargo brace of FIG. 1 showing greater detail its component structure and exemplary method of connection to vehicle floor.

FIG. 3 is a side view of the apparatus of FIG. 1, showing the same connected to the vehicle floor.

FIG. 4 is an alternative form of the invention.

DESCRIPTION OF THE INVENTION

With respect to FIG. 1 there is shown a conventional cargo, illustrated in the form of a truck which is backed onto the floor of the transporting vehicle and which is characterized by a pair of end doors 3*a* and 3*b*. The transporting vehicle 7 may be a flatcar or the like and is of conventional design. The end doors 3*a* and 3*b* could obviously be the end doors of a conventional container or other enclosure which is prone to pilferage or the other problems described herein above. The end doors 3*a*, 3*b* are hinged typically at their vertical side and adapted generally to be swung outwardly from the center. Commonly these doors are locked or latched together at the center of the container end. Obviously upon abrupt changes in acceleration, the load or cargo which is stored within the container 3 may be propelled toward one end or the other and burst upon the doors, thus fracturing the typical locking device 3*c*, forcing open the doors and causing the cargo to be thrust outwardly where it may thereafter obviously be damaged or cause damage.

The cargo brace 10 which is the subject hereof is generally characterized by an upstanding member 13 and a base member 15, forming an integral piece with one another. These two members are generally disposed in L-shaped configuration. Typically, there is connected to each of the members 13, 15 a diagonal reinforcing strut 17. The strut is of substantial design and generally affixed such as by welding.

Integrally characterizing the intersecting axes of the upstanding member 13 and base member 15 is a hinged means 21 configured to include a plurality of protuberances extending from the upstanding member 13 and including a bore 21*a* therethrough. Affixed to the floor of the transporting, such as by welding, is a plurality of cooperating protuberances 21*b* (see FIG. 2), each of which are characterized by an aligned bore 21*c*, this bore being adapted to be aligned with the bore 21*a* of the brace. The brace 10 is readily connected to the floor of the transporting vehicle upon alignment of the bores 21*a* and 21*c* and by insertion of the hinged pin 21*d* therethrough. Obviously, a typical cotter pin or the like (not shown) can be inserted through the ends of the hinged pin to prevent its removal from the aligned bores. Other hinging arrangements could be used in place of the one described so long as the functional objectives hereafter described may be accomplished.

The base member 15 may reside directly on and against the floor of the transporting vehicle. In the preferred embodiment, however, the base member 15 is disposed at an angle with respect to member 13 which may be slightly less than 90°. A biasing means 31, typically comprising a heavy duty spring, such as for example a coil spring, or a plurality of coil springs, is disposed beneath the base member 15. The biasing means 31 preferably would be affixed to the base means 15 so that the floor of the transporting vehicle would not be obstructed by them when the brace is in its stowed position. Obviously, the biasing means may take a variety of different forms. A leaf spring or other spring design may be substituted for the coil spring illustrated in FIG. 3. In FIG. 4, for example, there is shown a hard rubber pad configured to be inserted between the base member 15 and the floor and which, of course, may be affixed to the base member so as to clear the floor of obstructions when the brace is in its stowed position. Whatever the form of the biasing means 31, the advantage thereof resides in the flexibility imparted to the position of upstanding member 13. Because the upstanding member 13 is adapted to abut the doors in order to secure the cargo within the container, it is necessary that the container be backed up to and against the upstanding member when it is in its deployed position. In so doing the driver must take care to not back the container too far less damage be done to the doors or to the bracing means. Optimal positioning of the container with respect to the upstanding member would result in a substantial pressure exerted by the member against the door sufficient to preclude any movement whatever of the doors with respect to one another. The biasing means 31 thus enable the application of pressure on the doors, and continued backward movement of the container prior to the ultimate pressure to be exerted. As the base member approaches a parallel relation with the floor, the pressure against the doors of the container obviously increases. In order to prevent damage to the door during loading against the brace and during the subsequent transportation of the container a bumper pad 33 is affixed to the upper end of the upstanding member 13. The bumper pad 33 may be made of hard rubber or other shock absorbant, resiliant material.

The relative angular relationship between upstanding member 13 and base member 15 need not be 90°. The relationship may be either more or less. However, optimal operation of the brace during deployment against doors such as 3*a*, 3*b* is accomplished if the relationship is somewhat less than 90°. When the brace is in its upstanding position, such as is shown in FIG. 3, but where the doors are not in abutting relation to the brace, the normal position of member 13 with respect to the freight car floor will form an acute angle. This, of course, is caused by the biasing means 31 which exert an upward force and hence a forwardly tilting position to upstanding member 13. If it is desired to increase the height of base member 15 above the freight car floor by increasing the height of the biasing means, it may become advisable to reduce the angular relationship between the members 13 and 15 to less than 90° in order to impart a more nearly vertical position to the member 13 and, thus, improve the standing stability of the brace when it is not in an abutting relationship to the doors and during the loading operation.

Normally, the brace resides in its stowed position, that is, folded over and resting upon the floor of the transporting vehicle as shown in ghost in FIG. 1. As such the base member 15 and reinforcing strut 17 protrude above the floor but pose no obstacle to normal movement of a vehicle on the floor because of the central position of the brace with respect to the size of the transporting vehicle (railway car). Prior to or during movement of the truck or container 3 rearwardly toward the brace 10, the brace is lifted upwardedly to its deployed position. The brace may be fixed in its deployed position by insertion of a pull lever 35 through a wing bore 37 integrally connected to member 13. Insertion of the pull lever into the lever bore 39 in the floor of the transporting vehicle fixes the brace 10 in its deployed position so that an attendant need not necessarily hold the brace while the container approaches. As the container backs into contacting relation with the bumper pad 33, the brace moves into a position of enhanced pressure contact until the biasing means are compressed. It will be recognized that the truck driver can ascertain when the proper position has been reached or this may be done with the assistance of a helper. Likewise, a simple electrical contact (not shown) could be arranged between the base member 15 and the floor such that a circuit were closed when a predetermined position of base member 15 were reached thereby actuating a light or other signal for the driver.

The disclosed invention provides an economical, durable and reliable apparatus and method for transporting containerized cargo, or the like, with substantially no opportunity for pilferage or loss in route. Various modes of carrying out the invention are contemplated as being within the scope of the following claims and it is intended that all such modifications and changes be so included.

That which is claimed and desired to be secured by the United States Letters Patent is:

1. In a bracing means for wedging closed the door of a contained cargo on a transporting vehicle so as to preclude pilferage and spillage from the container comprising:

an upstanding member and a base member in unitary construction, the construction adapted to be hingedly affixed to the transporting vehicle proximate the base member so that the bracing means can be tipped to a stowed position on vehicle floor, and biasing means affixed to the base member of the bracing means for urging the upstanding member toward a contacting position with the door of the contained cargo, so as to exert pressure thereon when abutting contact is made.

2. The bracing means of claim 1 wherein the biasing means is a spring.

3. The bracing means of claim 1 wherein the biasing means is a resilient material.

4. The bracing means of claim 1 wherein the upstanding member is characterized by an upper end and a lower end, said upper end including a protective surface for contacting the doors so as to reduce damage thereto.

5. The bracing means of claim 4 and which includes a hinge means affixed thereto for hingedly connecting the brace means to the floor of the transporting vehicle, said hinge means and biasing means cooperatively acting to induce rotational movement of the bracing means about the hinge axes.

6. The bracing means of claim 5 wherein the upstanding member and base member define an acute angle therebetween.

7. The bracing means of claim 6 wherein the upstanding member is perpendicular to the floor of the transporting vehicle.

8. The bracing means of claim 6 wherein the upstanding member forms an acute angle with the portion of the floor of the transporting vehicle on which the bracing means rests when in its stowed position.

9. In a bracing means for wedging closed the door of a contained cargo on a transporting vehicle so as to preclude pilferage and spillage from the container comprising:

an upstanding member and a base member in unitary construction, the construction adapted to be hingedly affixed to the transporting vehicle proximate the base member so that the bracing means can be tipped to a stowed position on the vehicle floor, and, biasing means operatively associated with the bracing means for urging the upstanding member toward a contacting position with the door of the contained cargo so as to exert pressure thereon when abutting contact is made, said biasing means being disposed between the base member and floor of the transporting vehicle.

10. The bracing means of claim 9 wherein the biasing means is a spring.

11. The bracing means of claim 10 wherein the upstanding member is characterized by an upper end and a lower end, said upper end including a protective surface for contacting the doors so as to reduce damage thereto.

12. The bracing means of claim 11 and which includes a hinge means affixed thereto for hingedly connecting the brace means to the floor of the transporting vehicle, said hinge means and biasing means cooperatively acting to induce rotational movement of the bracing means about the hinge axes.

13. The bracing means of claim 12 wherein the upstanding member and base member define an acute angle therebetween.

14. The bracing means of claim 13 wherein the upstanding member is perpendicular to the floor of the transporting vehicle.

15. The bracing means of claim 13 wherein the upstanding member forms an acute angle with the portion of the floor of the transporting vehicle on which the bracing means rests when in its stowed position.

16. The bracing means of claim 9 wherein the biasing means is a resilient material.

17. In a bracing means for wedging closed the door of a contained cargo on a transporting vehicle so as to preclude pilferage and spillage from the container comprising:

an upstanding member and a base member in unitary construction, the construction adapted to be hingedly affixed to the transporting vehicle proximate the base member so that the bracing means can be tipped to a stowed position on the vehicle floor, and, biasing means operatively associated with the bracing means between the base member thereof and the transporting vehicle for urging the upstanding member toward a contacting position with the door of the contacined cargo so as to exert pressure thereon when abutting contact is made, said biasing means constituting a spring.

18. In a bracing means for wedging closed the door of a contained cargo on a transporting vehicle so as to preclude pilferage and spillage from the container comprising:

an upstanding member and a base member extending from the lower end of the upstanding member and in fixed relation thereto, the upstanding member being adapted to abuttingly contact the door of the contained cargo, the bracing means being hingedly affixed to the transporting vehicle proximate the juncture of the two members so that it can be tipped to a stowed position on the vehicle floor, and, said base member extending from said upstanding member in a direction opposite to the side of the upstanding member which contacts the door of the contained cargo thus reinforcing the pressure exerted on the cargo door by said upstanding member.

19. The bracing means of claim 18 wherein there is included biasing means operatively associated with the bracing means and the floor of the transporting vehicle for urging the upstanding member toward the cargo door.

20. The bracing means of claim 19 wherein the upstanding member is disposed in a substantially vertical position with respect to the floor of the transporting vehicle when the bracing means is in its operative position.

* * * * *